United States Patent [19]

Dankman et al.

[11] 4,311,310

[45] Jan. 19, 1982

[54] ELECTRONIC MAZE GAME

[76] Inventors: Scott Dankman; Richard C. Levy; Bryan McCoy, all of 1001 Spring St., Silver Spring, Md. 20910

[21] Appl. No.: 95,368

[22] Filed: Nov. 19, 1979

[51] Int. Cl.[3] ..... A63F 9/06

[52] U.S. Cl. ..... 273/109; 273/118 A; 273/153 R

[58] Field of Search ..... 273/108, 109, 118 A, 273/118 D, 153 R, 1 GA, 237, 238, 239, 242

[56] References Cited

U.S. PATENT DOCUMENTS

| | | | |
|---|---|---|---|
| 3,087,732 | 4/1963 | Curran | 273/153 R |
| 3,116,929 | 1/1964 | Kernodle | 273/153 R |
| 3,300,217 | 1/1967 | Franklin | 273/238 |
| 3,540,731 | 11/1970 | Muncey | 273/109 |
| 3,625,516 | 12/1971 | Handweller et al. | 273/153 R |
| 3,712,617 | 1/1973 | Ohlschlager | 273/153 R |
| 4,053,740 | 10/1977 | Rosenthal | 273/313 X |
| 4,236,718 | 12/1980 | Kaga | 273/153 R |
| 4,240,638 | 12/1980 | Morrison et al. | 273/153 R X |

*Primary Examiner*—William H. Grieb

*Attorney, Agent, or Firm*—Cushman, Darby & Cushman

[57] ABSTRACT

The present invention provides an electronic maze game wherein the player attempts to direct a playing piece through a maze to a goal within the maze. The goal is suitably indicated by a flashing LED on the game board. The position of the goal within the maze changes in a pseudo-random manner. In the preferred embodiment, the object of the game is to score as many goals in the shortest possible time, without passing through any forbidden zone in the maze. The forbidden zone is indicated by a flashing LED of a different color than the goal LED, and periodically changes position within the maze in a pseudo-random manner.

15 Claims, 3 Drawing Figures

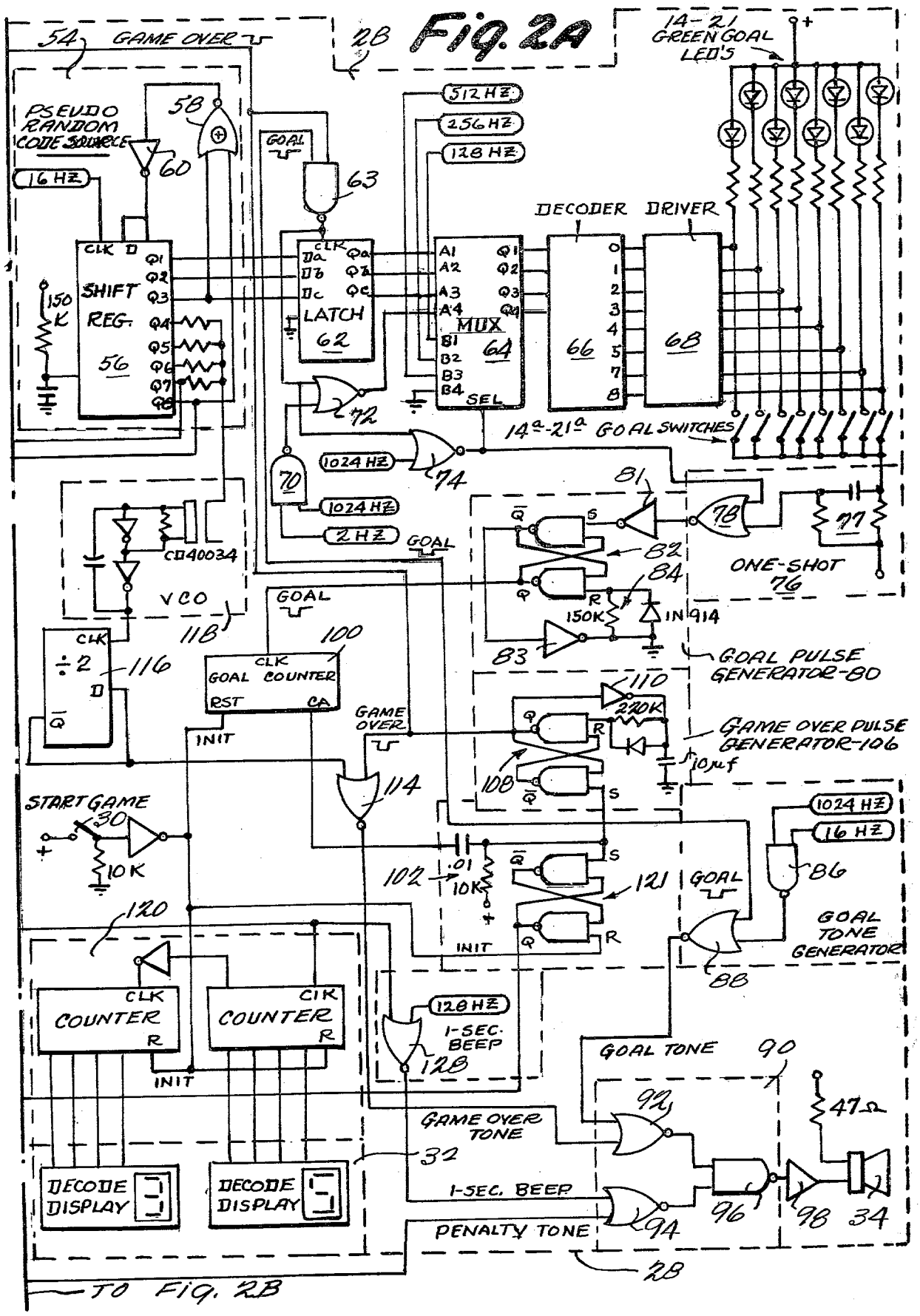
Fig. 2A
54
GAME OVER
28
14-21 GREEN GOAL LED'S
PSEUDO RANDOM CODE SOURCE
58
60
16 HZ
512 HZ
256 HZ
128 HZ
GOAL
63
DECODER
DRIVER
CLK
D
Q1
Q2
Q3
Q4
Q5
Q6
Q7
Q8
SHIFT REG.
56
150 K
LATCH
62
MUX
64
A1
A2
A3
A4
B1
B2
B3
B4
SEL
66
68
14a-21a GOAL SWITCHES
72
1024 HZ
74
70
2 HZ
CD40034
VCO
118
÷2
116
GOAL COUNTER
100
RST
CA
INIT
GAME OVER
114
START GAME
30
10K
81
78
77
ONE-SHOT 76
82
84
150K
IN914
83
GOAL PULSE GENERATOR-80
110
220K
GAME OVER PULSE GENERATOR-106
10μf
108
102
.01
10K
121
86
GOAL TONE GENERATOR
88
120
COUNTER
128 HZ
1-SEC. BEEP
128
GOAL TONE
90
92
47Ω
GAME OVER TONE
32
DECODE DISPLAY
1-SEC. BEEP
96
98
34
PENALTY TONE
94
28
TO Fig. 2B 2B
22-25
RED PENALTY
LED'S
DRIVER
DECODER
144
140
MUX
142
LATCH
130
512 HZ
256 HZ
0.25 HZ
132
PENALTY
SWITCHES
22a-25a
154
PENALTY
SIREN
168
÷2
CLK
166
VCO
4.7K
156
.01
417K
ONE
SHOT
158
1024 HZ
GAME
OVER
150
152
146
148
1024 HZ
4 HZ
172
136
138
150K
PENALTY
PULSE
GENERATOR
-134-
5μf
160
162
.01
10K
164
150K
4 HZ
5μf
170
124
126
.22
1 HZ
470K
122
GAME OVER
FF
OSC.
50
1024 HZ
512 HZ
CD4040
CNTR
0.125 HZ
TIMING
48
28
FROM Fig. 2A

ELECTRONIC MAZE GAME

BACKGROUND OF THE INVENTION

The present invention relates to maze games, and, in particular, to an electronic maze wherein the ultimate goal periodically changes in a pseudo-random manner.

In general, maze games are well known. For example, various maze games utilize a self-powered object, typically mechanical, to transverse a maze. Such a maze is described in U.S. Pat. No. 3,087,732 issued Apr. 30, 1963 to R. J. Curran. Another class of maze games utilize a pulley system or the like to control movement of a magnetic member disposed beneath a game board, and movement of the magnetic member causes corresponding movements of a game piece to the face of the board. Maze games of this type are described in U.S. Pat. Nos. 3,116,929 issued Jan. 7, 1964 to C. C. Kernoodle and 3,712,617 issued Jan. 23, 1973 to N. Oslager.

Similarly, electronic games utilizing CRT, LED or LCD displays are known. A video game system, for example, is described in U.S. Pat. No. 4,053,740 issued Oct. 11, 1977 to L. D. Rosenthal.

SUMMARY OF THE INVENTION

The present invention provides an electronic maze game wherein the player attempts to direct a playing piece through a maze to a goal within the maze. The goal is suitably indicated by a flashing LED on the game board. The position of the goal within the maze changes in a pseudo-random manner. In the preferred embodiment, the object of the game is to score as many goals in the shortest possible time, without passing through any forbidden zone in the maze. The forbidden zone is indicated by a flashing LED of a different color then the goal LED, and periodically changes position within the maze in a pseudo-random manner.

BRIEF DESCRIPTION OF THE DRAWING

A preferred exemplary embodiment of the present invention will hereinafter be described in conjunction with the appended drawing wherein like numerals denote like elements and:

FIGS. 2A and 2B show suitable circuitry for a maze game in accordance with the present invention.

DETAILED DESCRIPTION OF A PREFERRED EXEMPLARY EMBODIMENT

Figure 1:
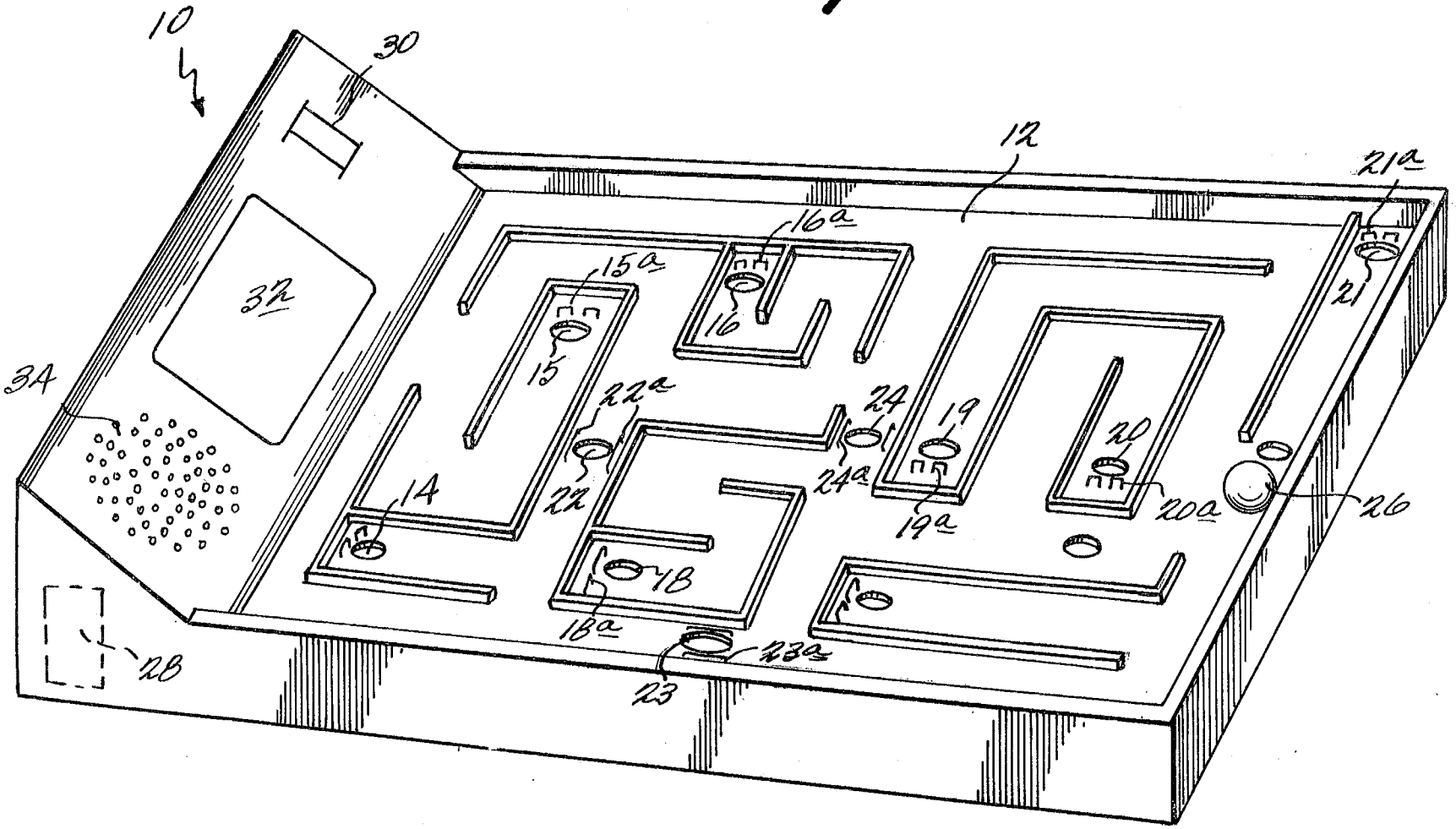
FIG. 1 is a pictorial representation of one embodiment of the game board of the present invention.

Referring now to FIG. 1, an electronic maze game in accordance with the present invention comprises a base 10. Base 10 has mounted on the upper face thereof a game board 12 which suitably includes a bas-relief maze. A plurality of controllably actuated visual indicia, such as lights, LED's, or the like are mounted in the upper face of base 10 for exposure on game board 12. In the preferred embodiment, eight green LED's 14 through 21, and four red LED's 22 through 25 are utilized. The front face of base 12 also has mounted thereon a plurality of switches, **14*a*–25*a*, associated with the respective LED's. Electrical connections are effected between LED's 14–25 and switches 14*a*–25*a* and an electronic module 28 disposed within base 10 (conductors not shown in FIG. 1). Also mounted in base 10, and cooperating with electronic module 28 is an on/off (game start) switch 30, a display 32 and a speaker or other electrical to audio transducer 34**.

Switches **14*a*–25*a* may be of any suitable type capable of momentarily changing state when passed over by a playing piece 26. Playing piece 26 is suitably a conductive ball, and switches 14*a*–25*a* comprise two conductive members disposed on game board 12 so that a conductive path is effected therebetween through conductive ball 26 as ball 26 passes over or strikes the conductive pieces. The conductive members of switches 14*a*–25*a* are suitably mounted in base 10 and project through apertures in game board 12. The conductive pieces 14*a*–21*a* associated with green LED's 14–21, project beyond game board 12 so that ball 26 effects a closure of the switch when striking the conductive members. On the other hand, the conductive members 22*a*–25*a* associated with red LED's 22–25 project only slightly above the game board so that movement of ball 26 over the conductive members is substantially unobstructed. A closure of respective switches 22*a*–25*a* is effected as ball 26** rolls over the conductive members associated therewith.

It should be noted that game board 12 can be, if desired, removably secured to base 10, and a plurality of different game boards can be utilized. Game board 12 would then include apertures or transparencies disposed for alignment with LED's 14–25. In the alternative, separate sets of LED's 14–25 and conductive members of switches **14*a*–25*a* can be permanently fixed in each of the respective game boards 12 and separable electrical connections made to control module 28** by conventional techniques.

Movement of the game piece (conductive ball 26) is suitably effected by tilting base 10, and accordingly, game board 12 in one direction or another. Electronic module 28 designates a "goal" by causing one of the green LED's 14–21 to flash and designates a forbidden or penalty zone by causing one of the red LED's 22–25 to flash. Basically, the object of the game is to cause ball 26 to traverse game board 12 to effect a closure of the switch associated with the flashing goal LED, without closing the switch associated with the flashing penalty LED. However, the forbidden zone (indicated by the flashing penalty LED) periodically switches among LED's 22–25, in a pseudo-random manner. In the preferred embodiment, the player scoring ten goals in the shortest amount of time wins, and each traversal of a penalty zone penalizes the player by incrementing his time by a predetermined amount, e.g., two seconds. The goal LED is pseudo-randomly changed each time a goal is scored. In addition, each time a goal is scored, an audio indicia is generated. A different audio indicia is also generated when a penalty occurs. A third sound is generated upon completion of the game. In addition, if desired, a beep is sounded each instance the time count is incremented after the start of the game to provide time perspective for the player.

Figure 2B:
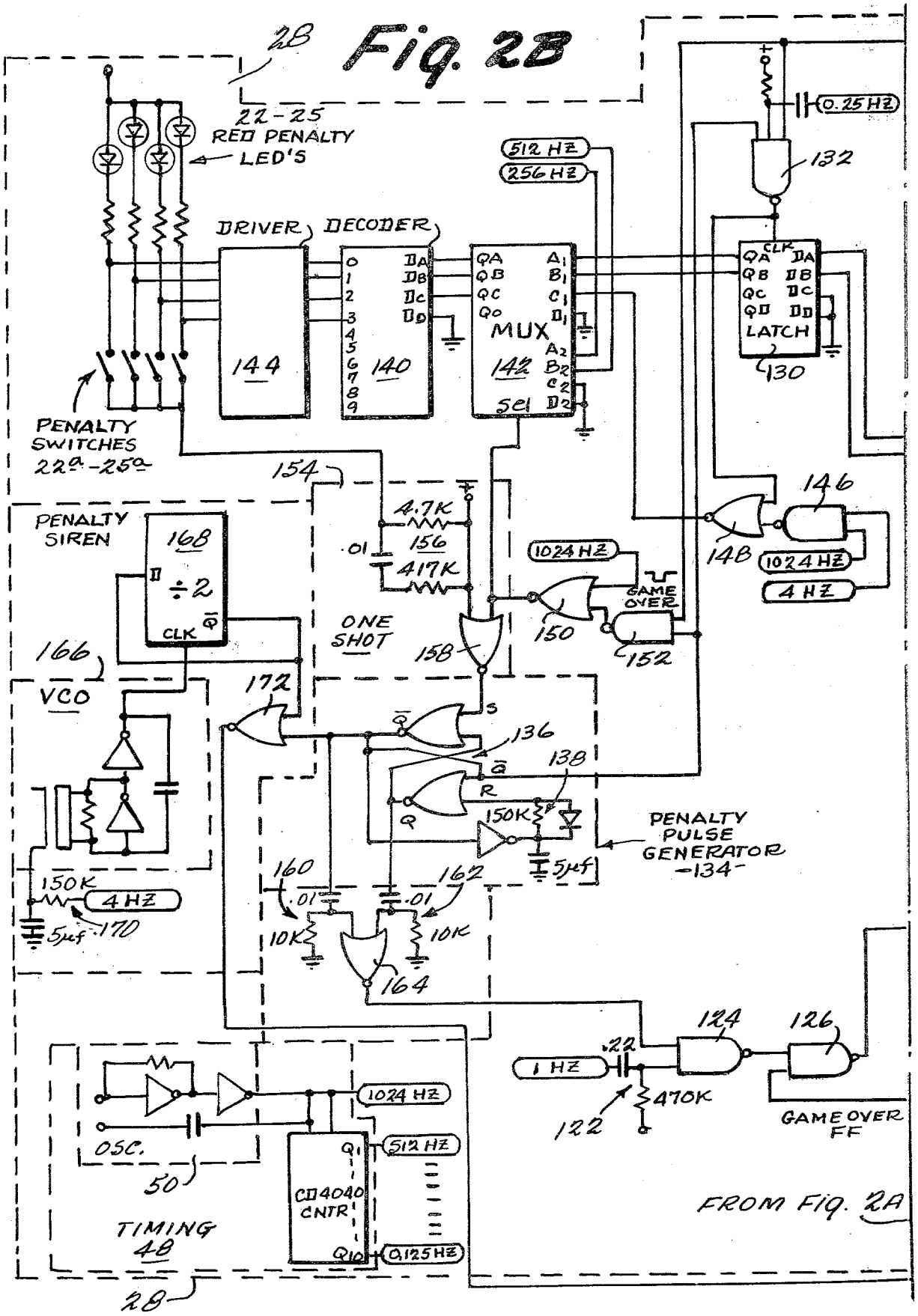

Electronic module 28 effects a pseudo-random change of the designated goal and penalty LED/switches, controllably generates the electrical signals corresponding to the various sounds generated by the maze game, maintains a goal count indicative of the number of goals scored and a time count indicative of playing time and driver display 32. Referring now to FIGS. 2A and 2B, the structure and function of electronic module 28 will be more fully described.

Clock signals at a plurality of frequencies ranging from 1024 Hz to 0.125 Hz are provided by a timing circuit 48 (FIG. 2B). Timing circuit 48 comprises a 1024 Hz oscillator 50 and a counter 52. Counter 52 is suitably a National Semiconductor CD4040 12-bit binary ripple counter.

A particular goal LED is selected from LED's 14–21 on a pseudo-random basis. A pseudo-random data source 54 generates a 3-bit pseudo-random number changing value at a 16 Hz rate. In essence, the 3-bit pseudo-random code is decoded, and the corresponding one of the green LED's 14–22 is made to flash. Pseudo-random data source 54 comprises a shift register 56, a two input exclusive OR gate 58 and an inverter 60. Shift register 56 is suitably a National Semiconductor MM74C164 8-bit parallel-out serial shift register. As is well known in the art, in response to positive-going transitions applied to the clock input (CLK) of the shift register, the logic level instantaneously applied to the data input (D) is loaded into the first stage and data is serially shifted between the successive stages of the shift register. Respective parallel outputs Q1–Q8 of shift register 58 provide signals indicative of the content of the respective stages of the shift register. A 16 Hz squarewave signal from counter 52 of timing circuit 48 is applied as a clock signal to shift register 56. The contents of shift register 56 are made to vary in a pseudo-random fashion by combinatorial feedback of various output terminals of the shift register through exclusive OR gate 58. The input terminals of exclusive OR gate 58 are coupled to respective parallel outputs of shift register 56. In the preferred embodiment, exclusive OR gate 58 receives signals from the third (Q3) and last (Q8) output terminals of shift register 56. The output terminal of exclusive OR gate 58 is coupled through inverter 60 to the data input of shift register 56. The 3-bit pseudo-random number generated in the first three stages of shift register 56 (Q1, Q2, Q3) is applied in parallel to the respective data input terminals $D_a$, $D_b$, $D_c$ of a 3-bit latch 62.

Latch 62 temporarily stores the pseudo-random code representing the goal LED (hereinafter referred to as the latched goal code) and controllably latches new pseudo-random goal codes. Latch 62 is suitably a National Semiconductor CD4042 quad-clocked D-latch (with the fourth stage thereof, tied low). Latch 62, in response to a positive-going transition applied to the clock terminal (CLK) thereof transfers the respective instantaneous logic levels at the D-input terminals to the corresponding Q output terminals. As will hereinafter be explained, latching of a new pseudo-random goal code is effected in response to either a negative-going "goal" pulse (generated each time a goal is scored) or a negative-going "game over" pulse (generated after scoring a predetermined number of goals) applied to the respective inputs of a 2-input NAND gate 63.

The latched goal code provided at the outputs of latch 62, is applied together with a squarewave of predetermined frequency (to effect flashing, as will be described), through a multiplexer 64, to a decoder 66. Decoder 66, in effect, intermittently activates one of eight driver circuits associated with green LED's 14–21 in accordance with the latched goal code.

Decoder 66 is suitably a National Semiconductor CD4028 BCD to decimal decoder which generates a high level output signal at the selected one of ten output terminals in accordance with the 4-bit input code applied thereto. The 3-bit latched goal code from latch 62 is applied through multiplexer 64 to the three least significant inputs of decoder 66. The latched goal code designates the particular LED's 14–21 to be activated.

The predetermined frequency squarewave is utilized to effect flashing of the particular one of LED's 14–21 designated by the latched goal code. The squarewave is applied to the most significant input of decoder 66. When the squarewave signal applied to the most significant input of decoder is high, an "illegal" code is applied to the decoder 66. The illegal code results in none of the LED's being illuminated. Thus, the LED designated by the 3-bit latched pseudo-random goal code applied to the three least significant inputs of decoder 66 is flashed on and off in accordance with the state of the squarewave applied to the most significant input of decoder 66.

The squarewave applied to the most significant input of decoder 66 is generated by a two input NAND gate 70 having a 1024 Hz squarewave and a 2 Hz squarewave applied to the respective inputs thereof. The resultant squarewave output of NAND gate 70 is gated through a two input NOR gate 72 to multiplexer 64 in accordance with the latch control signal generated to latch 62 by NAND gate 63.

The 3-bit pseudo-random code and flash squarewave can be, if desired, applied directly to the four input terminals of decoder 66. However, for cosmetic reasons, it is desirable that all of the green LED's 14–21 be illuminated and that the particular goal LED be designated by a more brilliant flashing. This function is performed by multiplexer 64.

Multiplexer 64 is suitably a National Semiconductor MM74C157 quad two input multiplexer, in effect, comprising four two input multiplexers with a common select input. When a zero is applied to the select (SEL) input of multiplexer 64, the logic values on a first set of inputs (A1, A2, A3, A4) are impressed on the corresponding Q outputs of the multiplexer. Conversely, when a logical one is applied to the select (SEL) input, the logical values at a second set (B1, B2, B3, B4) of inputs are provided at the corresponding Q output terminals of the multiplexer. The 3-bit latched goal code from latch 62 is applied to the three least significant (A1, A2, A3) of the first set of inputs. The "flashing" squarewave is applied to the most significant (A4) input of the first set. The three least significant (B1, B2, B3) of the second set of inputs of multiplexer 64 have applied thereto 512 Hz, 256 Hz, and 128 Hz signals from timing circuit 48, respectively. The most significant (B4) input of the second set is tied low to avoid generation of illegal states by decoder 66.

Multiplexer 64 is made to rapidly switch between the first and second set of inputs. A 1024 Hz signal is gated through a NOR gate 74 to the select (SEL) input of multiplexer 64 in accordance with the control signal to latch 62 from NAND gate 64. When the second set of multiplex inputs are applied to decoder 66, a cyclic illumination of each of the LED's is effected at a rate such that flickering is undiscernable to the human eye. The non-selected green LED's thus appear illuminated, but less brilliantly than the flashing goal LED.

When a goal is scored by effecting closure of the switch associated with the designated goal LED, a negative-going pulse is generated to cause a goal tone to be sounded, a new pseudo-random goal code to be latched over by latch 62, and the goal count to be incremented.

Switches **14*a*–21*a* are coupled between the driver circuit 68 to the goal LED associated therewith, and the trigger input of a suitable one-shot 76. One-shot 76 suitably comprises a shaping circuit 77 and a two input NOR gate 78. One of the conductors of switches 14a–21a is connected to the associated LED driver circuit 68. The other of the conductors of each of the switches 14a–21a is connected to the input of shaper circuit 77. When conductive ball 26 effects a closure of the switch connected to the LED driver designated by the latch goal code, the driving voltage to the goal LED is momentarily applied to shaper circuit 77. Shaper circuit 77 generates a pulse, which pulse is generated through NOR gate 78 to a pulse generator circuit 80 (hereinafter referred to as "goal pulse generator" 80**).

One-shot 76 is, however, disabled during the periods that the second (B) set of multiplexer 64 inputs are coupled to decoder 66. The output of NOR gate 74 is applied to one input of NOR gate 78 to inhibit passage of pulses generated during "B" input periods. The inhibition prevents spurious generation of goal pulses by closure of a non-selected switch 14a–21a.

Goal pulse generator 80 suitably comprises an inverter 81, RS flip-flop (FF) 82, an inverter 83, and a delay circuit 84. The pulse from one-shot 76 is applied, through inverter 81, to the set (S) input of FF 82. The $\overline{Q}$ output of FF 82 is inverted and applied to delay circuit 84. The output of delay circuit 84 is, in turn, applied to the reset input (R) of FF 82. Goal pulse generator 80 thus generates a negative-going pulse of a duration in accordance with the delay circuit 84 upon closure of one of the goal switches 14a–21a. The pulse duration is suitably on the order of two seconds. The negative-going goal pulse is applied to one input of NAND gate 63 to effect a latching of a new pseudo-random goal code by latch 62 each time a goal is scored.

The negative-going goal pulse is also utilized to effect generation of a goal tone each time a goal is scored. A tone is generated by applying respective 1024 Hz and 16 Hz squarewaves from timing circuit 48 to the respective inputs of a two input NAND gate 86. The electrical goal tone signal is gated through a two input NOR gate 88 for the duration of the negative-going goal pulse, to suitable combinatorial (mixer) logic 90. Combinatorial logic 90 suitably comprises respective two input NOR gates 92 and 94 having the outputs thereof coupled to the respective inputs of a two input NAND gate 96. Combinatorial logic 90, in effect, mixes the goal tone with a plurality of other tones, as will be explained, and applies the respective tones to a driver amplifier 98 associated with transducer 34. Transducer 34 generates an audio signal in accordance with the electrical inputs thereto. Thus, an audio goal tone having particular characteristics is generated for a predetermined period established by the duration of the goal pulse (e.g., two seconds) each time a goal is scored.

A running count of the goals scored is maintained in a counter 100 (hereinafter referred to as goal counter 100). Goal counter 100 is suitably a National Semiconductor MM74C160 decade counter with asynchronous clear. The goal pulse is applied to the clock input of goal counter 100. Goal counter 100 is thus incremented each time a goal is scored. As will hereinafter be explained, goal counter 100 is cleared upon initiation of the game. After a predetermined goal count (e.g., ten seconds) is attained, a carry-over pulse is generated at the carry-over (CA) output of counter 100. The carry-over pulse from goal counter 100 signifies the end of the game.

When the predetermined number of goals is reached (e.g., ten), as signified by generation of the carry-over signal by a goal counter 100, a "game over" pulse of predetermined duration is generated to cause all of the LED's to flash, and to cause generation of a game over tone having a distinct predetermined audio characteristic. The carry-over pulse from counter 100 is applied to a pulse shaper circuit 102. Shaper circuit 102 is, in turn, coupled to the trigger input of a pulse generator 106 (hereinafter referred to as the "game over pulse generator"). Game over pulse generator 106 suitably comprises a flip-flop 108 cooperating with an inverter 110 and delay circuit 112.

Game over pulse generator 106 generates, in response to the carry-over pulse from goal counter 100, a negative-going "game over" pulse of a predetermined duration in accordance with the time constant of delay circuit 112, e.g., five seconds. The carry-over pulse from goal counter 100 is applied to the set input of FF 108. The Q output of flip-flop 108 is fed back to the reset (R) input thereof through inverter 110 and delay circuit 112.

During the duration of the "game over" pulse, all of the LED's 14–25 are flashed and a distinctive game over tone is sounded. The negative-going game over pulse is applied to NAND gate 63 to enable NAND gate 63 for the duration of the pulse. Latch 62 thus effectively couples the various pseudo-random codes generated by shift register 56 (changing at a 16 Hz rate) to decoder 66. The green LED's 14–21 are thus flashed on and off in a pseudo-random manner. Red LED's 22–25 are also flashed through a similar mechanism, as will be explained.

To effect the sounding of the game-over tone, the negative-going game over pulse is applied to a two input NOR gate 114. The other input terminal of NOR gate 114 is coupled to the output of a divide-by-two flip-flop 116 coupled to a voltage controlled oscillator (VCO) 118. The control input to VCO 118 is derived from the pseudo-random signal generated by shift register 56. More particularly, a plurality of outputs of shift register 56, e.g., Q4, Q5, Q6, Q7, are tied through respective resistors (e.g., having values 10K, 47K, 22K, 10K) to a common junction, which is, in turn, coupled to the control input of VCO 118. The resistors operate, in effect, as a variation of digital-to-analog converter. VCO 118, in effect, generates a signal having a pseudo-randomly varying frequency. Divide-by-two flip-flop 116 operates to generate a squarewave at the varying frequencies, and provides amplitude symmetry to the signal. NOR gate 114 generates the game over tone signal to combinatorial logic 90 for the duration of the game over pulse. Combinatorial logic 90, in turn, applies the game over tone signal to driver 98, causing transducer 34 to generate a corresponding audio signal.

As noted above, in the preferred embodiment, the object of the game is to score the predetermined number of goals in the shortest time. Provisions for determining the time period and for providing indicia of the time period are included. A counter 120, suitably formed of two National Semiconductor MM74C160 decade counters with asynchronous clear, are clocked by a 1 Hz signal from timing circuit 48 during the period defined by an initialization pulse (INIT) generated at the start of the game, and the scoring of the predetermined number of goals. The carry over pulse from goal counter 100 is applied to the set (S) input of a flip-flop FF 121. The 1 Hz signal is applied through shaping circuitry 122 to one input of a two input NAND gate 124. NAND gate 124 is gated by logic circuitry associated with the penalty aspect of game 10, as will be explained. The output of NAND gate 124 is gated through a two input NAND gate 126 in accordance with the Q output of FF 121. The output of NAND gate 126 is coupled to the clock input (CLK) of counter 120. Counter 120 (hereinafter timer 120) is initially reset, along with goal counter 100 and flip flip 121 upon the starting of the game (closing of switch 30). NAND gate 126 is enabled upon the resetting of flip flop 121, and pulses generated at one second intervals are passed through NAND gates 124 and 126 to increment timer 120.

Timer 120 is connected to display 32. Display 32 provides indicia of the instantaneous content of timer 120. Timer 120 continues to accumulate a count at the 1 Hz rate until the goal counter 100 generates a carry pulse indicative of the end of the game, whereupon flip flop 121 is set and NAND gate 126 inhibited.

As previously noted, a one second beep, that is, a beep sound occurring at one second intervals, is included, to provide a time reference for the player. The one second beep is generated by a 2-input NOR gate 126 and the other input thereof having applied a 128 Hz signal from timing circuit 48. A beep signal is, thus, generated each time timer 120 is incremented. The output of NOR gate 128 is applied to combinatorial logic 90. Combinatorial logic 90, in turn applies the electrical one second beep signal to driver 98 to cause transducer 34 to generate corresponding audio signals.

As previously noted, an additional dimension is provided in the maze game by inclusion of a randomly changing penalty zone. If ball 26 passes through the activated penalty zone, the player is penalized by increasing the time count in timer 120 by a predetermined amount, e.g., two counts.

The activated penalty zone is chosen on a pseudo random basis in a manner similar to the selection of the goal, and is signified by a brilliant flashing of one of the red LED's 22–25. A two bit pseudo random code provided at respective output terminals (e.g., Q7 and Q8) of shift register 56 in pseudo random code source 54 are applied to the data A ($D_a$) and data B ($D_b$), inputs of a latch 130 similar to latch 62. The data c ($D_c$) and data D ($D_d$) inputs of latch 130 are tied low.

Latch 130 is controlled through application of a signal to the clock input thereof generated by a 3-input NAND gate 132. The input terminals of NAND gate 132 have applied a 0.25 Hz signal from timing circuit 48, the negative-going game-over pulse from game-over pulse generator 106, and the $\overline{Q}$ output terminal of a slip flop 136 of a pulse generator 134 (hereinafter penalty pulse generator 134).

The output terminals of latch 130 are applied to the two least significant bit inputs of a decoder 140 through a multiplexer 142 decoder 140 and multiplexer 142 are similar to decoder 66 and multiplexer 64, respectively.

The output of decoder 140 is applied to respective driver circuits 144, similar to driver circuits 68. The respective driver circuits 144 are coupled to red LED's 22–25. A squarewave signal of predetermined frequency and duty cycle is applied to multiplexer 142. The predetermined frequency and duty cycle squarewave is generated by a 2-input NAND gate 146 having a 1024 Hz signal and a 4 Hz signal from timing circuit 48 applied to the respective inputs thereof. The squarewave signal is gated to multiplexer 142 (and thus to the most significant bit input of decoder 140) by a 2-input NOR gate 148 controlled in accordance with the output of the latch control signal generated by 3-input NAND gate 132.

The pseudo random selection of the penalty zone LED is analogous to the pseudo random selection of the goal LED. Latch 130 captures a pseudo random code (hereinafter referred to as the penalty code) from shift register 56. A new penalty code is latched every four seconds (0.25 Hz) and also in response to the closure of the activated penalty switch *22a–25a*. In addition, latch 130 is opened for the duration of the game over pulse to cause a brilliant flashing of all of the LED's in a pseudo random fashion.

The penalty code provided at the output of latch 130 designates a particular one of the red LED's 22–25 and switch *22a–25a* as the penalty zone. The squarewave of predetermined frequency applied to the most significant bit input of decoder 140, when high, in effect, generates an illegal code to decoder 140 causing no LED to be illuminated. Thus, the designated LED flashes on and off in accordance with the signal applied to the most significant bit input of decoder 140.

As in the case of green LED's 14–21, it is desirable that all of the red LED's appear to be illuminated and that the particular penalty LED flash more brilliantly than the others. Accordingly, multiplexer 142 is interposed between latch 130 and decoder 140. Multiplexer 142 is similar to multiplexer 64. The output of latch 130 is coupled to the least significant bits of the first set of inputs (A1, A2) and the predetermined frequency and duty cycle squarewave is applied to the next most significant bit input (A3). The most significant bit of the first set of inputs (A4) is tied low. The two least significant bits of the second set of inputs (B1, B2) are coupled to a 256 Hz and 512 Hz signal from timing circuit 48, respectively. Multiplexer 142 alternately provides at the output terminals thereof the signals applied at the first set of inputs (A1–A4) and the second set of inputs (B1–B4). A 1024 Hz signal from timing circuit 48 is selectively applied to the select input of multiplexer 142 to effect the alternation between sets of inputs. The 1024 Hz signal is gated to the select input (SEL) of multiplexer 142 through a 2-input NOR gate 150. One input of NOR gate 150 is receptive of the 1024 Hz signal. The other input receives the output signal of a 2-input NAND gate 152. NAND gate 152 is responsive to the negative-going game-over pulse and to the $\overline{Q}$ output from penalty pulse generator 134. Thus, the multiplexer 142 is locked on the A inputs thereof during the game-over pulse, and for the duration of the penalty pulse, as will be explained.

When the particular designated one of switches *22a–25a* is closed by passage of ball 26, timer 120 is incremented by a predetermined number of counts, e.g., 2, a penalty siren sound is generated for a predetermined period and all of the red LED's 22–25 are brilliantly flashed. One conductor of each of switches *22a–25a* is connected to the respective driver circuit associated with the corresponding LED 22–25. Each of the other conductors of switches 22–25 is connected in common to a one-shot 154.

One-shot 154 includes a pulse shaping circuit 156 and a 2-input NOR gate 158. The second conductors of switches *22a–25a* are all connected to the input terminal of shaper circuit 156, which is in turn, coupled to one input of NOR gate 158. The other input of NOR gate 158 is receptive of the output of NOR gate 150. Thus, NOR gate 158 is enabled only during such periods that the penalty code and squarewave from the first set of multiplexer inputs are applied to decoder 140. The pulse generated in response to closure of the particular penalty LED is passed through NOR gate 158 (unless inhibited) a pulse generator 134 (hereafter penalty pulse generator 134).

Penalty pulse generator 134 includes a flip flop 136, cooperating with inverter 137 and a delay circuit 138 coupled in series between the $\overline{Q}$ output of flip flop 136 and the reset (R) input thereof. NOR gate 158 is coupled to the set(s) input of FF136. Penalty pulse generator 134 generates a negative-going penalty pulse at the $\overline{Q}$ output of flip flop 136 and a positive-going penalty pulse at the Q output of flip flop 136. As previously noted, the negative-going penalty pulse generated at the $\overline{Q}$ output of flip flop 136 is applied to NAND gates 152 and 132 to effect control of multiplexer 142 and NOR gate 158, a latch 130, respectively.

As previously noted, timer 120 is incremented by two counts each time the particular penalty switch associated with the designated penalty LED is tripped. The $\overline{Q}$ and Q outputs of flip flop 136 are coupled to respective differentiator circuits 160 and 162. The outputs of differentiators 160 and 162 are applied to the respective inputs of a 2-input NOR gate 164. Differentiators 160 and 162 and NOR gate 164, in effect, cooperate to generate negative-going spikes at the leading and trailing edge of the penalty pulse generated by penalty pulse generator 134. Thus, each time the activated penalty switch is tripped, two pulses are generated through NOR gate 164. The pulses from NOR gate 164 are applied to the second input of NAND gate 124. The spikes are passed through NAND gates 124 and 126 in addition to the "one second pulses" to increment timer 120 by two counts (one count each).

A penalty siren is also sounded for the duration of the penalty pulse (e.g., two seconds) each time an activated penalty switch is tripped. An electrical signal representative of a siren sound is generated by a voltage controlled oscillator (VCO) 166, in cooperation with a divide-by-two flip flop 168 and an integrator circuit 170. Integrator circuit 170 receives a 4 Hz squarewave signal from timing circuit 48. Integrator 170 in effect, shapes the squarewave into a sawtooth wave signal for application as a frequency control signal to VCO 166. Divide-by-two flip flop 168, in effect, squares, e.g., amplitude limits, the VCO output. The electrical penalty siren signal is gated through a 2-input NOR gate 172 for the duration of the penalty pulse generated by penalty pulse generator 134. More specifically, the output of divide-by-two flip flop 168 is applied to one input of NOR gate 172, and the other input thereof is tied to the $\overline{Q}$ output of flip flop 136. The output of NOR gate 172 is applied through combinatorial logic 90 to driving amplifier 98. Speaker 34 thus generates a siren sound for the duration of the penalty pulse.

It will be understood that the above description is of illustrative embodiments of the present invention and that the invention is not limited to the specific form shown. For example, maze game 10 can readily by adapted for a game wherein the playing period is fixed and the object of the game is to score as many goals as possible within that period. The goal counter would be coupled to a suitable display through latching circuits. The goal counter would be latched over to the display until the generation of a game-over signal upon timing out of counter 120. Counter 120 would suitably be a presetable decrementing counter. Similarly an up down counter could be utilized for goal counter 100. Pulses generated by NOR gate 164 would then be utilized to decrement the goal counter as a penalty. Also, latch 62 can readily be adapted to latch over a new goal code on a periodic basis, in a manner similar to that used to effect periodic changes of the penalty zone. In addition, it should be appreciated that the various functions provided by module 28 can also be effected through an appropriately programmed microprocessor, if desired. These and other modifications may be made in the design and arrangement of the elements without departing from the spirit of the invention as expressed in the appended claims.

What is claimed is:

1. An electronic game comprising:

a game board adapted for cooperation with a playing piece, said playing piece being movable with respect to said board;

a plurality of controllably actuable visual indicia disposed on said board;

at least one switch means associated with each of said visual indicia, for generating, when enabled, an electrical goal signal in response to the presence of said game piece at a predetermined position on said board corresponding to said associated visual indicia;

actuation means, responsive to a code signal applied thereto, for enabling at least a particular one of said switch means as in accordance with said code signal and actuating the visual indicia associated with said particular one of said switch means;

pseudo-random generator means, for generating said code signal to said activation means and pseudo-randomly varying said code signal; and counter means, cooperating with each of said respective switch means, and responsive to said goal signals for developing a count indicative of the number of times said goal signal is generated.

2. An electronic game comprising:

a game board adapted for cooperation with a playing piece, said playing piece being moveable with respect to said board;

a plurality of controllably activated visual indicia disposed on said board;

at least one switch means associated with each of said visual indicia, for generating, when activated, an electrical goal signal in response to the presence of said game piece at a predetermined position on said board corresponding to said associated visual indicia; and electronic means for psuedo randomly activating particular ones of said switch means and said associated visual indicia, and for counting instances of generating said electrical goal signal.

3. In a maze game of the type including a playing piece and a game board, said playing piece being moveable with respect to said game board, and said game board having a movement restraining maze thereon, said piece being moveable within said maze, the improvement wherein said maze game includes:

a plurality of selectively actuable visual indicia disposed on said board in said maze;

selectively enableable switch means disposed on said board in said maze proximate to said visual indicia for generating, when enabled, an electrical goal signal in response to a cooperation with said playing piece;

actuation means, responsive to code signals applied thereto, for selectively enabling at least one particular switch means in accordance with said code and activating the visual indicia proximate to said particular switch means;

pseudo random code generator means for generating said code signal to said actuation means and pseudo randomly varying said code signal; and counter means, responsive to goal signals from said respective switch means for developing a count representative of the number of cooperations between said playing piece and enabled switching means.

4. An electronic game comprising:

a game board adapted for cooperation with a playing piece, said playing piece being movable with respect to said board;

a plurality of controllably actuable visual indicia disposed on said board;

a plurality of selectively enableable switch means, at least one switch means being associated with each of said visual indicia, for generating, when enabled, a goal signal in response to interaction between said switch and said game piece;

decoder means, responsive to a control code signal applied thereto, for enabling at least one particular switch means in accordance with said control code, and for activating the visual indicia associated with the particular enabled switch means;

means for generating a pseudo-random signal representative of a pseudo-random code, said pseudo-random code changing value at predetermined intervals;

latch means, responsive to said pseudo random code signal and to control signals applied thereto, for controllably applying signals indicative of said pseudo random code to said decoder means as said control code signal;

means, responsive to goal signals from said plurality of switch means, for developing a signal indicative of the number of interactions between said playing piece and enabled switch means; and means for generating an audio sound having distinct characteristics in response to each interaction between said playing piece and enabled switch means, in response to interactions between enabled switch means and said playing piece.

5. The game of claim 1 further including timer means, responsive to a signal indicative of said count, for generating a time count representative of the time period taken to generate said predetermined number of goal signals.

6. The maze game of claim 3 further comprising:

timer means, responsive to a signal indicative of said count, for developing a time count indicative of the time period taken to effect a predetermined number of cooperations between said playing piece and enabled switching means.

7. The game of claim 4 further comprising:

timer means, responsive to a signal indicative of said count, for generating a time count indicative of the time taken to effect a predetermined number of interactions between said playing piece and said enabled switch means.

8. The game of claim 7 further comprising:

a second plurality of visual indicia disposed on said board, said second plurality of visual indicia being distinguishable from said first mentioned plurality of visual indicia;

a second plurality of selectively enableable switch means disposed on said board for generating, when enabled, a penalty signal in response to each interaction between said playing piece and said enabled switch means of said second plurality of switch means, at least one of said second plurality of switch means being associated with each of said second plurality of visual indicia;

means for generating a second pseudo random code signal representative of a second pseudo random code, said pseudo random code changing value at predetermined intervals;

second decoder means responsive to a penalty code signal applied thereto, for enabling at least a particular one of said second plurality of switch means in accordance with said penalty code and activating the visual indicia of said second plurality of visual indicia associated with said enabled one of said second plurality of switch means; and means, responsive to said penalty signal, for incrementing said time count by a predetermined amount in response to each interaction between said playing piece and said enabled one of said second plurality of switch means.

9. The game of claim 8 further including:

means, responsive to said penalty signal for generating a second audio sound having predetermined characteristics.

10. The game of claim 4 further comprising:

means, responsive to said goal signal for generating a control signal to said latch means to effect application of a new pseudo random code as said control code to said decoder means, whereby particular enabled switch means is pseudo randomly changed after interaction between said particular enabled switch means and said playing piece.

11. The game of claim 8 further comprising:

means, responsive to said goal signals for generating a control signal to said first mentioned latch means each time a goal signal is generated.

12. The game of claim 8 or 11 further comprising:

means, responsive to said penalty signals, for generating a control signal to said second latch means to effect application of a new second pseudo random code to said second decoder as said penalty code each time a penalty signal is generated.

13. The game of claim 12 further comprising:

means for generating a further control signal to said second latch means to effect application of new second pseudo random code to said second decoder means as said penalty code at regular predetermined intervals.

14. The game of claim 1, 3, or 4 further including:

means, responsive to a signal indicative of said count for generating an audio sound when said count is equal to a predetermined number.

15. The game of claim 1, 2, 3, 4, or 8 wherein said visual indicia are LED's.

* * * * *